United States Patent [19]

Gevers et al.

[11] 4,175,745

[45] Nov. 27, 1979

[54] RACKET

[75] Inventors: Georges A. Gevers, Liège; Philippe M. Jeghers, Esneux, both of Belgium

[73] Assignee: FN International Société Anonyme, Luxembourg

[21] Appl. No.: 873,951

[22] Filed: Jan. 31, 1978

[30] Foreign Application Priority Data

Jul. 8, 1977 [BE] Belgium ..... 256066
Jan. 12, 1978 [LU] Luxembourg ..... 78855

[51] Int. Cl.[2] ..... A63B 49/02
[52] U.S. Cl. ..... 273/73 C; 273/73 K
[58] Field of Search ..... 273/67 R, 73 R, 73 C, 273/73 D, 73 F, 73 H, 73 K, 76

[56] References Cited

U.S. PATENT DOCUMENTS

| | | | |
|---|---|---|---|
| 2,878,020 | 3/1959 | Robinson | 273/73 F |
| 3,690,658 | 9/1972 | Howe | 273/73 C |
| 3,814,423 | 6/1974 | Shockley et al. | 273/73 C |
| 3,879,035 | 4/1975 | Danchulis et al. | 273/73 C |
| 3,917,267 | 11/1975 | McGrath | 273/73 C |
| 3,934,876 | 1/1976 | Haddad | 273/73 C |
| 4,042,238 | 8/1977 | Theriault | 273/73 C |

*Primary Examiner*—Richard J. Apley
*Attorney, Agent, or Firm*—Bacon & Thomas

[57] ABSTRACT

Improved racket, characterized by the fact that it is substantially made up of two identical metal shells, between which is fitted a honeycomb, these elements being mutually made integral by gluing.

3 Claims, 5 Drawing Figures

RACKET

The present invention pertains to an improved racket, for instance for playing tennis.

The main purpose of the invention is to supply a racket which is both light and particularly rigid, thereby providing great precision in play.

A further purpose of the invention is to allow an easy industrial fabrication of such a racket.

These purposes are reached, in accordance with the invention, by a racket substantially consisting of two identical metal shells, between which a honeycomb is located, these elements being made integral by gluing.

The honeycomb is preferably in the shape of a strip, starting at the end of the shaft, passing the stringing so as to return to the shaft. The grip may be built in the form of a sheath out of some synthetic material such as for instance polyurethane. Various dimensions of grips can be foreseen, the fitting thereof on the racket being carried out at the sales location, so as to limit the stock of rackets.

It should be noted that it has already been suggested to manufacture tennis rackets comprising a honeycomb core of synthetic material, upon the opposite surfaces of which plane trimming strips are glued, consisting of fibres in a synthetic resin matrix (see U.S. Pat. No. 3,856,603).

As compared with the present invention, this known manufacturing technique is of markedly higher cost and does not permit achieving a similar degree of strength or rigidity, for an equal weight.

On the other hand, it has also been suggested to use a metal honeycomb, fitted between two plane striking surfaces, for manufacturing paddle ball rackets (U.S. Pat. No. 3,879,035). This method of fabrication can of course not be applied to tennis rackets, which are subjected to much more severe operating stresses (general dimensions, open frame, stringing, length of shaft).

In order to show the characteristics and advantages of the invention more clearly, an example of fabrication of the latter will be described hereinafter with reference to the appended drawings in which.

Figure 1:
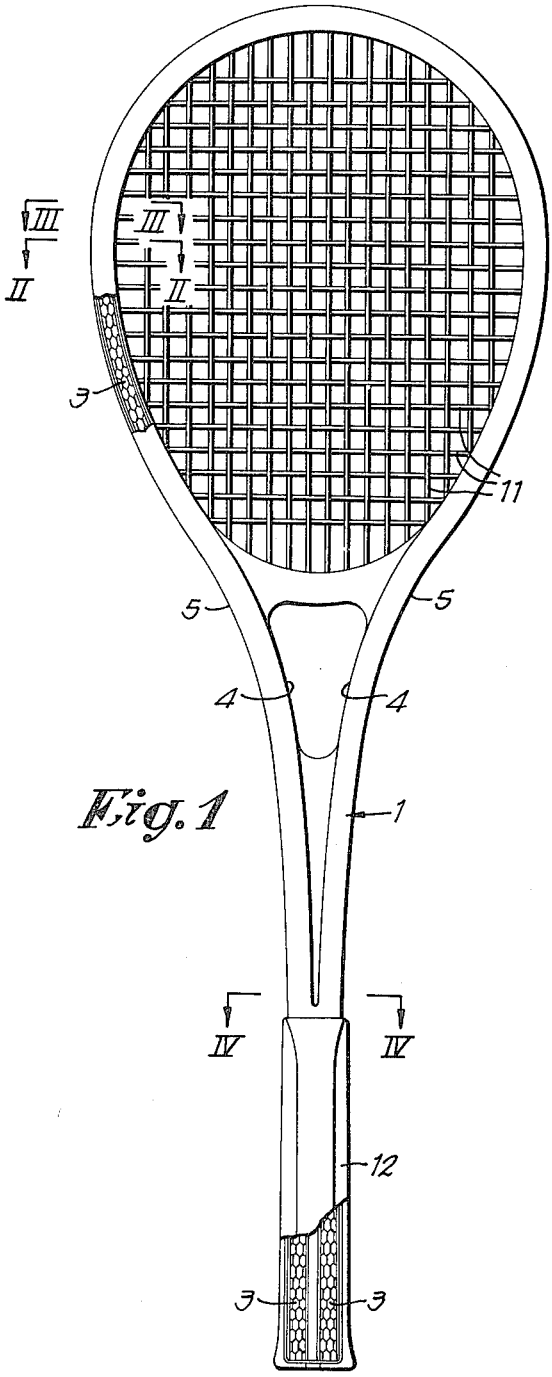
FIG. 1 is a front view of a racket according to the invention with parts broken away.
Figure 5:
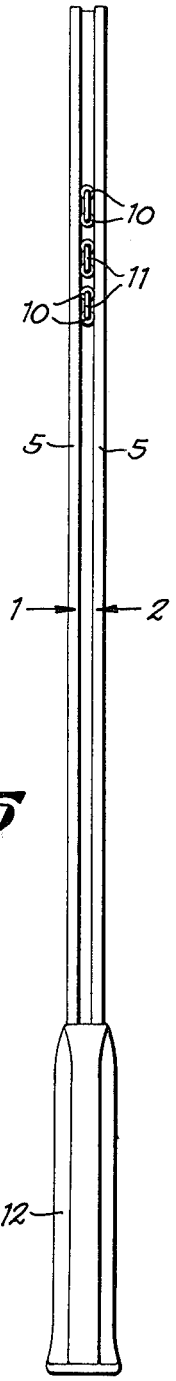
FIG. 5 is a side view of the racket according to FIG. 1.
Figure 2:
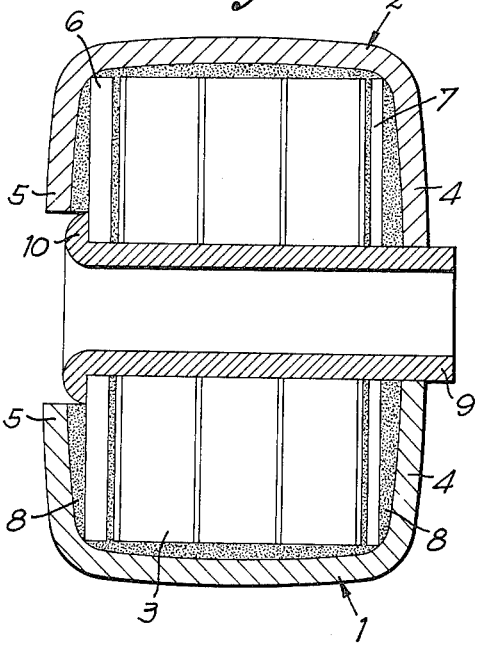
FIGS. 2 to 4 are sections, respectively taken on lines II—II, III—III and IV—IV in FIG. 1.
Figure 3:
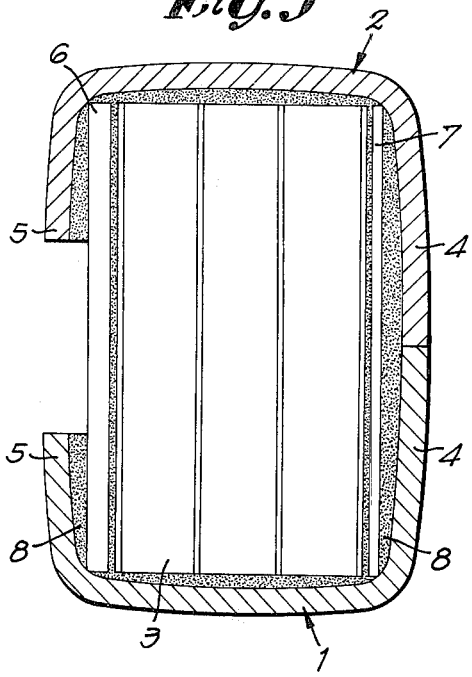
Figure 4:
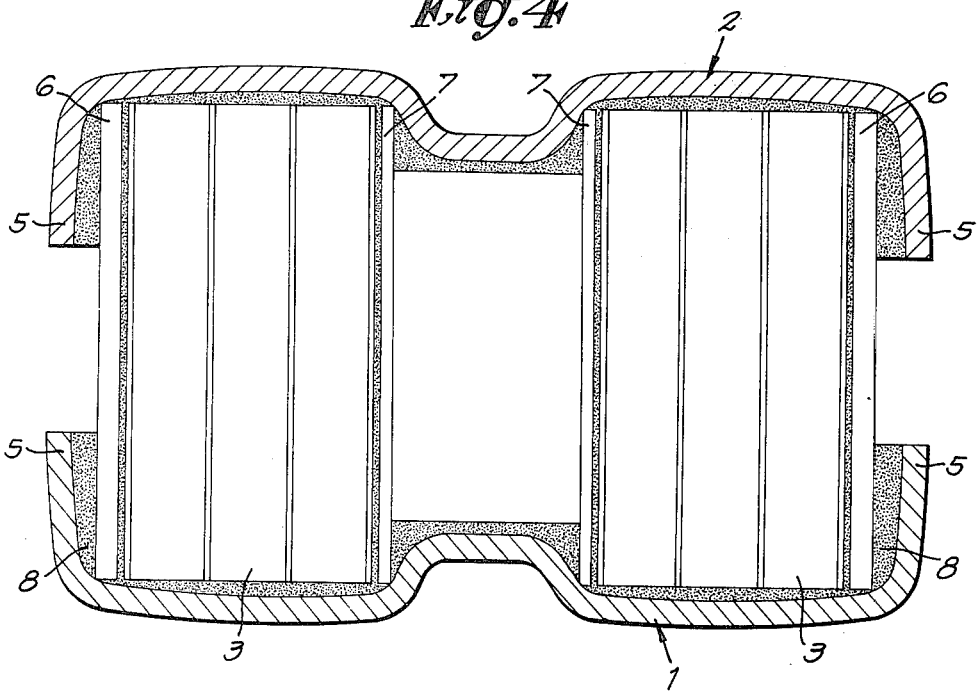

The racket shown is mainly made up, according to the invention, of two identical metal shells 1 and 2, between are is fitted a honeycomb armature 3, also of metal for instance.

Shells 1 and 2 are stampings and are of a generally U-shaped cross-section, which is single for the frame and double for the shaft.

With respect to the frame, the branch of the U located on the inside of the stringing, identified by reference 4, is longer than the outside branch 5, the height of armature 3 being approximately equal to twice that of a branch 4.

Armature 3, manufactured in the form of ribbon, has a metal strip, respectively 6 and 7 on either side thereof.

This ribbon and these strips are fitted between the two shells 1 and 2, so as to extend from the free end of the racket shaft straight through this shaft, around the stringing, and then again through the shaft up to aforementioned end of same.

Elements 1–3, 6 and 7 are mutually assembled by some appropriate adhesive, shown as 8.

This assembly having been carried out, regularly spaced holes are drilled through strip 6, honeycomb 3, strip 7 and branches 4 of shells 1 and 2. In each of these holes, a bushing 9 of synthetic material is fitted.

Each bushing is provided, at one end, with a small collar 10, the outer diameter if which is very slightly less than the width which separates branches 5 of shells 1 and 2.

These bushings are used for passing the strings 11 which they protect.

A grip 12, manufactured in the shape of a sheath—for instance of some appropriate polyurethane, is slipped round the end of the racket shaft, which may possibly have been previously coated with glue.

This arrangement has advantages in as far as the rackets can be supplied to the sales locations without grips, the latter being supplied separately in various dimensions, shapes, weights, hardnesses, appearances, outer textures, etc. This allows a reduction of the range of rackets to be held in store, the fitting of the grip chosen by the customer being carried out at the time of purchase.

It is obvious that numerous alterations can be applied to the above-described example, without going beyond the scope of the invention.

For instance, the honeycomb 3 might be arranged differently than shown in the drawings, wherein the axes of the honeycomb cells are perpendicular to the plane of the stringing. For constructional facility, it may indeed offer advantages to orient the honeycomb with the axes of the cells parallel to aforesaid plane of the stringing. This would permit the trimming of shells 1 and 2, without adversely influencing the characteristics of the racket, in as far as aforesaid shells are of sufficient thickness.

What we claim is:

1. A racket having a generally planar frame consisting of a loop for supporting stringing and a shaft integral with and extending from said loop, said frame comprising a pair of identical metallic members and a strip of honeycomb ribbon between said metallic members, said metallic members and honeycomb ribbon being adhesively secured together, said metallic members being at least partly of U-shaped cross section with their concave sides facing each other, said ribbon extending between said metallic members throughout said loop and the length of said shaft, wherein the U-shaped cross section of said metallic members comprises inner legs, on the inner periphery of said loop, being longer than the legs on the outer periphery of said loop, the ends of said outer legs being spaced apart.

2. A racket as defined in claim 1, wherein at least a portion of said ribbon is provided with metallic reinforcing strips on opposite side thereof extending from one metallic member to the other.

3. A racket as defined in claim 1, wherein spaced openings for strings extend through said loop, a bushing in each opening, each bushing having a collar at its outer end, said collars being of a diameter only slightly less than the space between the ends of said outer legs.

* * * * *